United States Patent [19]

Friedberg

[11] 4,232,429

[45] Nov. 11, 1980

[54] SLIDING FASTENER

[76] Inventor: Martin F. Friedberg, 7233 Aberdeen, Dallas, Tex. 75230

[21] Appl. No.: 940,255

[22] Filed: Sep. 7, 1978

Related U.S. Application Data

[63] Continuation-in-part of Ser. No. 895,935, Apr. 13, 1978, abandoned.

[51] Int. Cl.[3] ..... A44B 19/36

[52] U.S. Cl. ..... 24/205.11 R; 24/208 A

[58] Field of Search ..... 24/205.11 R, 205.11 F, 24/208 A

[56] References Cited

U.S. PATENT DOCUMENTS

| | | | |
|---|---|---|---|
| 2,203,005 | 6/1940 | Wittenberg et al. | 24/205.11 R |
| 4,139,927 | 2/1979 | Heimberger | 24/205.11 F X |

FOREIGN PATENT DOCUMENTS

| | | | |
|---|---|---|---|
| 117965 | 6/1930 | Austria | 24/205.11 R |
| 29568 | of 1912 | United Kingdom | 24/205.11 R |
| 363596 | 12/1931 | United Kingdom | 24/205.11 R |

*Primary Examiner*—Philip C. Kannan
*Attorney, Agent, or Firm*—V. Lawrence Sewell

[57] ABSTRACT

A sliding fastener applicable to separable zippers and the like is disclosed. Each half of the zipper or sliding fastener is provided with a terminal, one of which holds the zipper slider. Each of the terminals also includes one part of an insert fastener, whereby the terminals may be joined. The terminals further include means which guide the slider into engagement with the zipper teeth, once the parts of the insert fastener have been joined.

11 Claims, 37 Drawing Figures

SLIDING FASTENER

This application is a continuation-in-part of application Ser. No. 895,935, filed Apr. 13, 1978, now abandoned.

BACKGROUND OF THE INVENTION

This invention relates to sliding fasteners, such as zippers, and more particularly to improved terminals in those sliding fasteners wherein the two parts are routinely separated and rejoined, as for example, down the front of a coat.

A conventional separable zipper for a coat has a terminal at the bottom end of each half of the zipper. One terminal holds the zipper slider and will be referred to as the "slider terminal." The other terminal, which will be called the "free terminal" herein, is simply a pin with a shape slightly bent to fit properly in the slider. The slider terminal also includes a pin on which the slider rests. Rigidly connected to the slider terminal pin, at the rear of the slider, is a socket for receiving the free terminal pin. To join the terminals, the free terminal pin is inserted into the one front port of the slider which is empty. The fabric tape, or stringer, by which the zipper teeth and free terminal are connected together and to the garment, must be fed into the side slot of the slider at this point. Then the stringer is gripped to pull the free terminal pin all the way down into the socket of the slider terminal. It is usually necessary to grip both the free terminal stringer and the slide terminal to prevent the free terminal pin from rising out of the socket as the slider is being drawn away from the terminals to close the zipper. This gripping should be continued until a few of the teeth of the zipper are interlocked.

It is commonly recognized that the described process of closing a conventional coat zipper is not ideal, requiring a disproportionate amount of time, attention, and skill. The process is best carried out when the wearer is standing, so that the free terminal pin and the slider port and socket are roughly aligned for engagement. The wearer should pay reasonably close attention to the task and is preferably not running or walking, since the terminal parts are small and are not easily engaged when moving with respect to each other. The skills demanded represent a problem to small children, particularly the requirements of feeding the free terminal pin and stringer to a fully seated position in the socket, and then holding them there.

There have been various attempts to provide improved alternatives to the conventional separable sliding fastener. One example can be seen in U.S. Pat. No. 2,203,005 to E. Wittenberg, et al. There, one of the fastener terminals is provided with a pin which is oriented perpendicular to the plane of the stringer. The other terminal has a corresponding slot for receiving the pin and fastening the two terminals together. Once the terminals are fastened together, they are rotated around the pin into a position in which the slider may be pulled up to close the zipper. The disclosed devices have not supplanted the conventional design, perhaps because they deal with only some of the problems of the conventional fastener. One must still carefully interlock very small pieces in order to fasten the two terminals together. Then the free terminal must be fed through the side gap of the slider. One embodiment attempts to provide means for facilitating this feeding, but it requires an additional intricate fastening.

Another approach to the problems of conventional zippers is seen in U.S. Pat. No. 3,110,946 to K. Hara. There, a sliding fastener has two terminals each with relatively large interlocking parts at the bottom instead of the conventional pins and socket. A shortcoming of this device is that the free terminal must be inserted by the user through the side gap of the slider, while in the process of fitting together the interlocking parts. It appears that little in the way of overall ease of operation is provided by this or the Wittenberg devices; they serve mainly to emphasize the number of improvements which must be made on the conventional sliding fastener system to render it effortless and reliable.

SUMMARY OF THE INVENTION

In accordance with the present invention there is provided a sliding fastener having a slider base terminal, at an end of an elongated interlocking zipper element, for holding the slider in position to move along the zipper element. At a corresponding end of a second zipper element is a free terminal which fits together with the slider base terminal and guides the engagement of the slider with the second zipper element.

In one embodiment of the invention, the free terminal holds the end of the second zipper element in front of the slider in position to be engaged by the slider during zipping. This avoids the necessity for the user to feed the end of the second zipper element into the slider through the front of the slider or its side gap. One version of this embodiment includes means for rotating the terminals with respect to each other to move the end of the second zipper element into position in front of the slider. It is a convenience of the latter version that the terminals can be fitted together at various rotational angles with respect to each other. This reduces the necessity for the user to maintain a particular posture or alignment of the garment, as required with conventional sliding fasteners.

In another embodiment of the invention, the free terminal includes means for inserting the end of the second zipper element into one of the front openings of the slider and holding the zipper element just inside the opening, in a position to be engaged by the slider.

In yet another embodiment of the invention, each of the sliding fastener terminals includes one part of an insert fastener, and the terminals are fitted together by joining the parts of the insert fastener. In one version of this embodiment, the insert fastener is relatively large—on the order of the length of the slider. This makes the terminals generally easier to fit together and adds stability to the connection, thereby enhancing the capability of the device to guide the slider into engagement with the second zipper element. In this latter version, means are provided for completing the closure of the insert fastener before undertaking the remaining alignment of the terminals. Once the stable connection of the insert fastener is secured, the chore of aligning the slider and zipper elements is done by the terminals, rather than the user.

In one version of an embodiment with an insert fastener, the slider is held on or in one of the parts of the insert fastener. This permits the insert fastener to be relatively large in relation to the total size of the terminals. In addition, when the insert fasteners are circular, the position of the slider can be rotated with respect to the free terminal, as described above.

Thus, a number of embodiments are disclosed including features which allow the terminals to be connected with a minimum of skill, time, and attention. Moreover, the terminals include means for guiding the slider into engagement with the zipper elements in ways which require little additional attention of the user, once the terminals are connected.

As a result of its several advantages, the sliding fastener of the invention may be closed under considerably less than ideal conditions. It may be operated by small children. It can be fastened in the dark with little trouble. The whole process can be carried out in a hurry, on the run, and from a variety of postures.

These and other features and advantages of the invention will become apparent from a consideration of the following description of preferred embodiments.

DESCRIPTION OF PREFERRED EMBODIMENT

Figure 1:
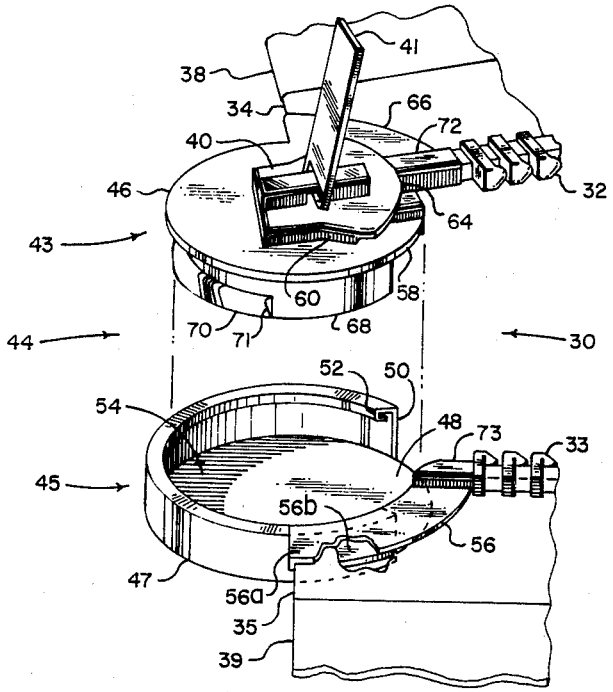
FIG. 1 is a perspective view of a sliding fastener according to the invention, in an unfastened position.
Figure 2:
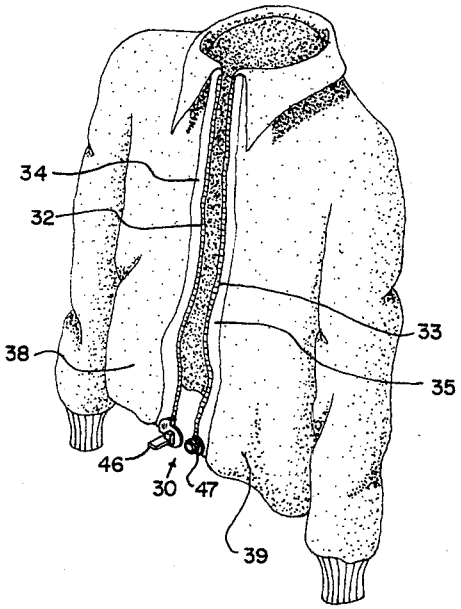
FIG. 2 is a perspective view of a sliding fastener according to the invention installed in a garment.
Figure 3:
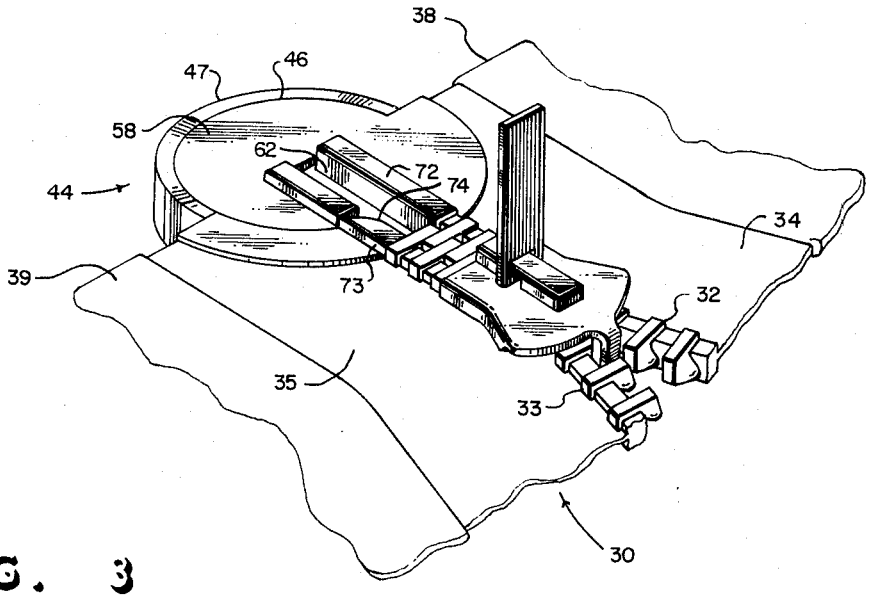
FIG. 3 is a perspective view of the sliding fastener of FIG. 1, in the closed position.

FIGS. 1-3 illustrate a sliding fastener in accordance with the invention, indicated generally by the reference numeral 30. Some parts of fastener 30 are the same as those of a conventional zipper. These include elongated interlocking elements 32 and 33, mounted on cloth stringers 34 and 35, respectively. The stringers 34 and 35 are attached as shown in FIG. 2, to sections 38 and 39 of a garment, for example by sewing. The sections 38 and 39 of the garment are fastened together when the elongated elements 32 and 33 are brought into side by side interlocking relationship as shown in FIG. 3, by the longitudinal motion of a slider 40 (FIG. 1) along elements 32 and 33, as is well-known. While zippers comprise the overwhelming majority of such fasteners in use, other sliding fasteners operating in a similar way are known, and the principles of the invention are generally applicable to them as well.

For clarity and convenience, certain directional terms will be adopted for use throughout this specification, with the recognition that the sliding fasteners described may have almost any orientation in space. The forward direction will be considered that direction in which the slider 40 moves when closing the fastener; that is, to the right in FIGS. 1 and 3. Rearward is, of course, in the opposite direction. References will be made to the elongated interlocking elements and the attached stringers as though they extended rigidly from the other parts of the fasteners with the interlocking elements being straight and the stringers being planar. Actually, these entities are flexible; they are considered rigid when it is useful in describing geometric relationships. Similarly, the plane of a stringer will be treated as the plane of the attached fabric or garment.

The upward direction will be considered that direction which is ordinarily pointing outward from the garment, upward in FIG. 1. Downward is in the opposite direction. The lateral or sideward directions are considered to be in the plane of the fabric and perpendicular to the interlocking elements 32 and 33.

It is important to discuss angles at which the fasteners of the invention are coupled. To do this, reference will be made to the angle between the interlocking elements, meaning the angle between one of the elements and the projection of the other element on the plane of the stringer of the one element.

At one end of interlocking element 32 is a slider base terminal 43. At a corresponding end of the interlocking element 33 is a receiving terminal 45. Terminals 43 and 45 include an upper part 46 and a lower part 47, respectively, of an insert fastener, indicated by the reference numeral 44. The lower part 47 preferably has a floor 48 and a wall 50 projecting upward around much of the periphery of the floor. A lip or overhanging member 52 projects inwardly from wall 50. A hollow or recess 54 is formed within wall 50 and above floor 48. A gap is provided in the front portion of the wall 50 for the purpose of allowing slider 40 to exit through front of terminal 45 when the terminals are fastened together. Extending over part of wall 50 and into the gap in the wall is a flange 56 for attachment of recessed part 47 to stringer 35.

The cutaway portion of flange 56 in FIG. 1 illustrates how the terminals 43 and 45 can be connected to stringers. Flange 56 has a top layer **56*a* and a bottom layer 56*b*, between which the material of stringer 35 is interposed. Flange 56 can be joined to stringer 35 by a chemical adhesive, or by thermally fusing layers 56*a* and 56*b*** to each other and to the stringer.

The parts may also be joined mechanically, as by pressing layers **56*a* and 56*b* and crimping or riveting them. Yet another method is to provide a series of holes extending through the layers of flange 56, so that the flange may be sewn or woven to stringer 35**.

Slider base terminal 43 has a base 58 capable of holding slider 40. The base 58 is of a thickness which fits between the side flanges of the slider such as flange 60. A slot 62 in base 58 accepts the post 64 which connects the top and bottom portions of the slider. A portion of base 58 is extended to form a flange 66 for attachment to stringer 34.

Upper part 46 of insert fastener 44 includes a wall 68, extending downward from base 58. Wall 68 conforms to the inside diameter of overhanging member 52 on lower part 47 and has a gap in the front to allow slider 40 to exit. At the rear of wall 68 is a projecting member 70. When insert fastener 44 is closed, member 70 is latched under overhanging member 52 of lower part 47. Member 70 has a cam surface 71 that helps it move beneath and latch under overhanging member 52. In order to assist the forward movement of the slider to fasten the interlocking elements 32 and 33, the terminals 43 and 45 are provided with respective guide segments 72 and 73.

In the operation of the sliding fastener 30, upper part 46 of insert fastener 44 is lowered into recess 54 of lower part 47. It is generally advantageous to perform the insertion with the base of slider base terminal 43 tilted at an angle to base terminal 45 as shown in FIG. 1. This allows projecting member 70 to be inserted beneath overhanging member 52 of the free terminal. Then the front of base terminal 43 may be lowered into position with base 58 overlying hollow 54.

If terminals 43 and 44 are made relatively flexible, then insert fastener upper part 46 can be inserted in lower part 47 with little or no tilt between them. The flexibility of the parts can be increased by choice of materials and also by placement of slits (not shown) in walls 68 and 50, perpendicular to base 58 and floor 48, respectively. The increased flexibility generally decreases the amount of care which must be exercised by the user in the insertion.

The upper part 46 of the insert fastener is capable of insertion in the lower part 47 with interlocking elements 32 and 33 separated by a wide angle, or disposed in parallel, as the case may be. Whatever the angle between elements 32 and 33, upper part 46 of the insert fastener is first fastened into the lower part 47, then rotated within the lower part until the guide segment 72 is aligned next to the guide segment 73. Guide segment 73 includes a cam surface 74 for guiding the post 64 of the slider 40. When the slider is pulled forward from base terminal 43, the slider post 64 moves along cam surface 74, passing between guide segments 72 and 73. Slider base terminal 43 rotates slightly with respect to the receiving or free terminal 45, as segment 72 is pushed away from segment 73 by post 64. As the rear part of slider 40 moves by, fastening the interlocking elements 32 and 33, guide segment 72 is pulled back to a position next to segment 73.

Once slider 40 has fastened interlocking elements 32 and 33, the sliding fastener appears as seen in FIG. 3. Sliding fastener 30 is securely fastened at this point. The way in which interlocking elements 32 and 33 can come apart is to peel away from each other in the plane of the stringers, that is, the reverse of the direction in which they move together for fastening. However, the joined parts of insert fastener 44 prevent interlocking elements 32 and 33 from separating in that plane. Conversely, the interlocking of elements 32 and 33 prevents the front of upper part 46 of the insert fastener from raising out of the lower part 47. The rear of lower part 46 is held within lower part 47 by the projecting member 70 latched beneath overhanging member 52 (FIG. 1).

Slide fastener 30 is unfastened by moving slide 40 onto base 58, and pulling up on flange 66, slider handle 41, or interlocking element 32, in order to remove upper part 46 of insert fastener 44.

Insert fastener 44 can be fabricated from a variety of materials, plastic being a preferred material. For example, fastener 44 can be made of nylon, ABS resin or polystyrene. If plastic is used, wall 50 of the lower part 47 of insert fastener 44 can flex when upper part 46 is inserted. If the parts are made of a metal such as brass with less flexibility than plastic, wall 68 of upper part 46 would be designed with a somewhat looser fit (than in a plastic model) to wall 50 and overhanging member 52 of the lower part 47, so that proper insertion of upper part 46 can be effected. In addition, the walls can be slitted to render them more flexible, as previously described.

Sliding fastener 30 provides a number of operational advantages. It is easy to use compared with the pin-in-socket terminals conventionally used. While the diameter of insert fastener 44 is subject to some choice, it will generally be considerably larger than, say, the diameter of the pin on the free end of a conventional zipper. This difference in scale makes insert fastener 44 considerably easier to operate just from the standpoint of the degree of care which must be exercised for successful use. Another requirement of dexterity with conventional terminals is the need to feed the stringer between the top and bottom portions of the slider. This is entirely avoided with sliding fastener 30.

Another problem in a conventional zipper is that motion of the slider intended to close the interlocking elements, tends to pull the free end pin out of its terminal socket. As a result, care must be taken to hold the pin in the socket, as the slider is moved away from the socket to close the zipper. Such an effort is not required with sliding fastener 30. When insert fastener 30 is closed, pulling slider 40 along intelocking elements 32 and 33 has no tendency to open fastener 44.

There is an additional advantage in designing insert fastener 44 to have a relatively large diameter. The mating of parts 46 and 47 over relatively extended distances works to maintain the two parts in precise alignment with respect to each other. This, in turn, provides smooth and reliable operation of the fastener 30.

It is difficult to define an optimum diameter or size for insert fasteners which are to be used with sliding fasteners according to the invention. The relative alignment of the terminals provided by the insert fastener varies not only with the size of the insert fastener, but also with the materials and tolerances employed. The size may be made as large as is considered practical for use with a particular garment. It is generally considered preferable for the parts of the insert fastener to have points of contact between them which are spread out over a distance on the order of (for example, 70 percent to 130 percent of) the length of the slider, or larger.

It is an important feature of sliding fastener 30 that slider base terminal 43 and receiving terminal 45 can be joined with interlocking elements 32 and 33 at almost any practical angle with respect to each other, including parallel to each other. This would allow a coat, for example, to be zipped conveniently while sitting or while running.

It is yet another advantage of sliding fastener 30 that, as described above, projecting member 70 latches fastener 30 against accidental separation, once elements 32 and 33 have been interlocked by slider 40.

Figure 4:
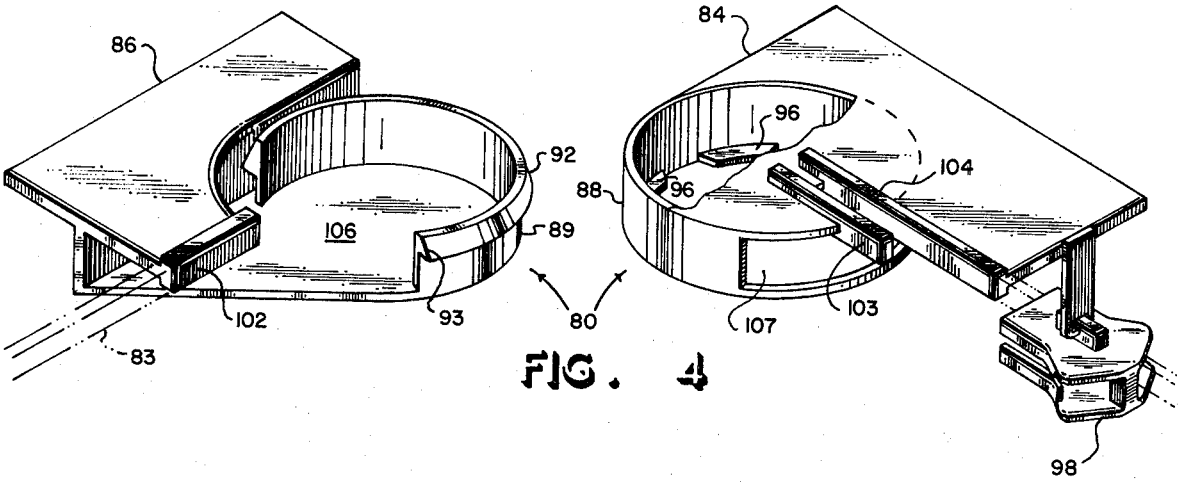
FIG. 4 is a perspective view of a second embodiment of the invention, in an open position.
Figure 5:
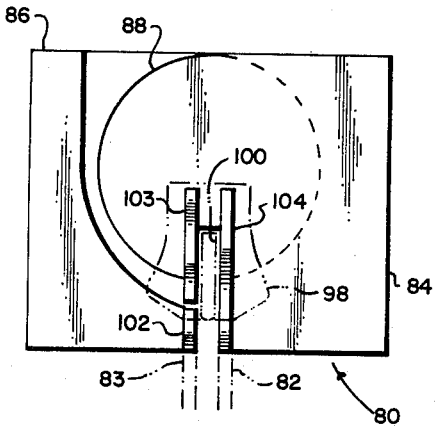
FIG. 5 is a plan view of the embodiment of FIG. 4, in a partially closed position.

FIGS. 4 and 5 illustrate another embodiment of a sliding fastener according to the invention, indicated generally by the reference numeral 80. In FIG. 4 and the figures which follow, the garment to which the sliding fastener is attached is not shown, and the elongated interlocking elements like elements 32 and 33 of FIG. 1 will be indicated only by broken lines. Thus, in FIG. 4, interlocking elements are indicated by reference numerals 82 and 83.

Connected to interlocking elements 82 and 83 are slider base terminal 84 and free terminal 86 respectively. Slider base terminal 84 includes an upper part 88 of an insert fastener, while free terminal 86 includes a corresponding lower part 89 of the insert fastener. Lower part 89 has an overhanging member 92 about the top thereof, including a cam surface 93. On the inside of upper part 88 are projecting members 96 to be latched under overhanging member 92 when the insert fastener is closed.

In the operation of the sliding fastener 80, slider 98 is first seated on slider base terminal 84, as shown in broken line in FIG. 5. Next, upper part 88 of the insert fastener, with its rear tilted downward, is lowered onto lower part 89, to latch members 96 beneath overhanging member 92. Cam surface 93 helps direct members 96 into the proper relationship with overhanging member 92. Then, the front of slider base terminal 84 is lowered to complete the fastening of part 88 on lower part 89.

Once parts 88 and 89 are assembled, upper part 88 is rotated clockwise with respect to lower part 89, until post 100 of slider 98 comes against the side of guide segment 102. Guide segment 102 approaches post 100 from the side, through the open frontal portions of the slider 98. Thus aligned, slider 98 may be moved forward along guide segments 103, 104 and 102, then along interlocking elements 82 and 83 to close sliding fastener 80. Along this path, the slider moves through gap 106 of free terminal 86 and through opening 107 of slider base terminal 84. If gap 106 is sized closely to the width of slider 98, then it will not be possible to pull the slider off base terminal 84 until terminal 84 is rotated into approximate alignment with guide segment 102.

To unfasten slide fastener 80, slider 98 is first moved fully rearward on to slider base terminal 84, which is then rotated slightly counterclockwise. Next, the front of the slider base terminal is lifted, and terminal 84 is moved slightly rearward to unlatch members 96 from beneath overhanging member 92.

Sliding fastener 80 possesses most of the same advantages of fastener 30 in FIGS. 1–3. It is easy to fasten. Moving slider 98 forward along interlocking elements 82 and 83 does not tend to pull apart upper part 88 and lower part 89 of the insert fastener. The relatively large diameter of the insert fastener parts 88 and 89 assure proper relative alignment of guide segments 102, 103 and 104, which is particularly important as slider 98 moves so that guide segment 102 is against post 100, partially within the slider. Once elements 82 and 83 are interlocked, they are prevented from separating by terminals 84 and 86, latched together by the interaction of members 96 and overhanging projection 92. Parts 88 and 89 of the insert fastener may be assembled at a variety of angles, but not with interlocking elements 82 and 83 parallel, since slider 98 would hit guide segment 102.

Figure 6:
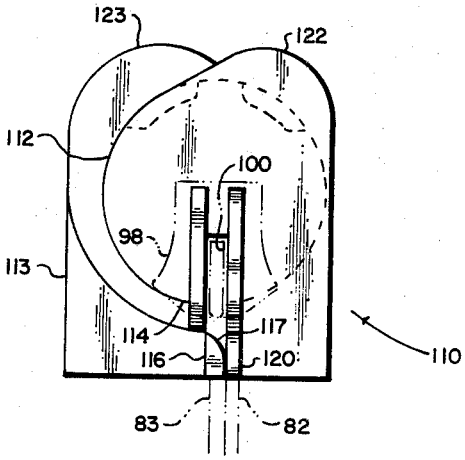
FIG. 6 is a plan view of a third embodiment of the invention, in a partially closed position.

FIG. 6 shows a sliding fastener 110 similar to fastener 80 in FIG. 5. In fastener 110, slider base terminal 112 is configured to receive slider 98 in such a way that the slider protrudes little from front surface 114 of the base terminal. Thus arranged, slider 98 does not envelope or overlap guide segment 116 of free terminal 113. As a result, slider base terminal 112 and free terminal 113 can be assembled with interlocking elements 82 and 83 parallel (or at an angle). Guide segment 116 has a facing with a cam surface 117 which is just in front of slider post 100 when guide segment 120 of base terminal 112 is against guide segment 116. When slider 98 is moved forward toward interlocking elements 82 and 83, post 100 slides along cam surface 117, causing slider base terminal 112 to rotate slightly with respect to free terminal 113, thus moving guide segments 116 and 120 apart so that post 100 can move between them.

FIG. 6 also illustrates how the sliding fastener of the invention can be provided with tabs to facilitate fastening and unfastening. In sliding fastener 110, slider base terminal 112 and free terminal 113 have planar extensions forming tabs 122 and 123, respectively.

Figure 7:
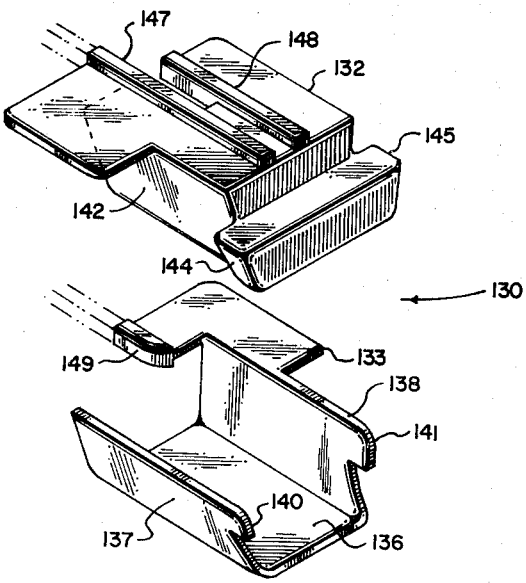
FIG. 7 is a perspective view of a fourth embodiment of the invention, in an open position.

In FIG. 7, there is illustrated another embodiment of a sliding fastener according to the invention, indicated by the reference numeral 130. It includes a slider base terminal 132, shown without a slider, and a free terminal 133. The free terminal 133 includes the lower part of an insert fastener, with a recess preferably formed by a floor 136 and walls 137 and 138 which extend upwardly and slightly outwardly from the floor. Projecting rearward on free terminal 133 are overhanging members 140 and 141.

Slider base terminal 132 has side walls and a bottom conforming to the inside walls and floor of the free terminal; only side wall 142 can be seen in FIG. 7. At the rear of slider base terminal 132 are formed sidewardly projecting members 144 and 145.

When fastening sliding fastener 130, a slider is seated completely rearward along guide segments 147 and 148 on the top of slider base terminal 132. Terminal 132 is lowered between the walls 137 and 138 of free terminal 133, while maintaining projecting members 144 and 145 rearward of overhanging members 140 and 141. The sidewardly projecting members 144 and 145 are latched beneath overhanging members 140 and 141, and slider base terminal 132 is rested against floor 136 of free terminal 133. In this position, guide segment 147 and 148 are properly aligned with guide segment 149 on the free terminal.

The insides of walls 137 and 138 of the free terminal 133 should be slightly farther apart than the outside of the lateral walls of slider base terminal 132. The difference in width should allow slider base terminal 132 to move away from guide segment 149 enough so that the center connecting post of the slider can move between guide segments 147 and 149. Then when elongated interlocking elements of the sliding fastener are interlocked by interaction of the slider, slide base terminal 132 should be capable of moving enough so that guide segments 147 and 149 can be adjacent.

Sliding fastener 130 generally possesses the same advantages of operation as fasteners 30 and 80 described hereinabove. In particular, the sliding fastener is latched against separation by the interaction of members 144 and 145 with overhanging members 140 and 141. Sliding fastener 30 is different, in that slider base terminal 132 may not be inserted in free terminal 133 when the elongated interlocking elements are at a substantial angle.

If free terminal 133 has a recess of a cylindrical shape or other curved shape, instead of distinct walls 137 and floor 136, the conditions of insertion will vary accordingly.

Figure 8:
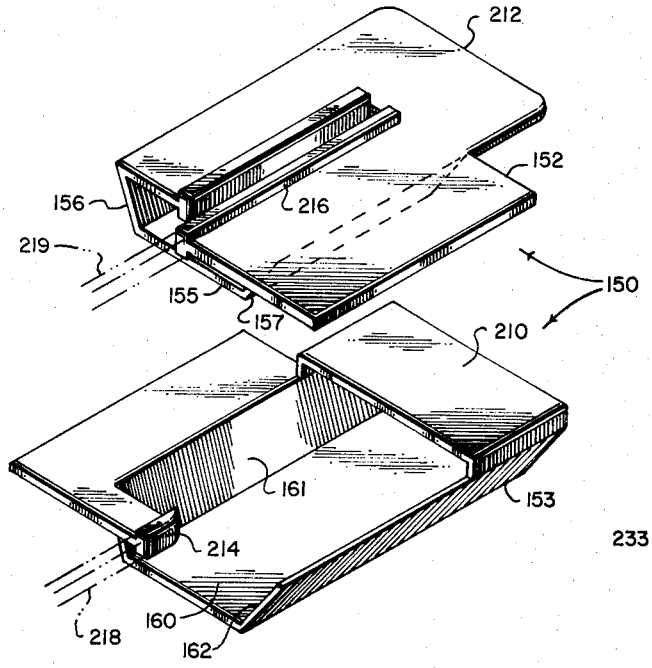
FIG. 8 is a perspective view of a fifth embodiment of the invention, in an open position.

FIG. 8 shows a sliding fastener 150 which is similar in certain respects to fastener 130 of FIG. 7. A slider base terminal 152 has a bottom 155 and side walls 156 and 157 which conform to the floor 160 and inside walls 161 and 162, respectively of a free terminal 153. At the rear of free terminal 153 is an overhanging member 210; in a corresponding location on slider base terminal 152 is member 212.

To fasten sliding fastener 150, slider base terminal 152, with its rear tilted downward, is lowered toward free terminal 153. Member 212 is latched beneath overhanging member 210; then slider base terminal 152 is seated against the floor and walls of free terminal 153. If the slider base terminal 152 is guided into potition by holding the slider handle, the rearward motion of the insertion will assure that the slider is seated completely to the rear on terminal 152. As with sliding fastener 130 of FIG. 7, terminal 152 must be able to move sufficiently laterally within terminal 153, so that guide segments 214 and 216 will separate for the passage of the slider post and then move together during fastening of the attached interlocking elements 218 and 219.

When member 212 is being inserted beneath overhanging member 210, it is acceptable if terminal 152 and 153 are aligned with a small angle between interlocking elements 218 and 219. This initial alignment of terminals 152 and 153 is somewhat less critical than that for terminals 132 and 133 of slide base 130 in FIG. 7. Terminal 152 may not be inserted into terminal 153 at the large horizontal angles possible with the round insert fasteners of FIGS. 1–6, however.

Figure 9:
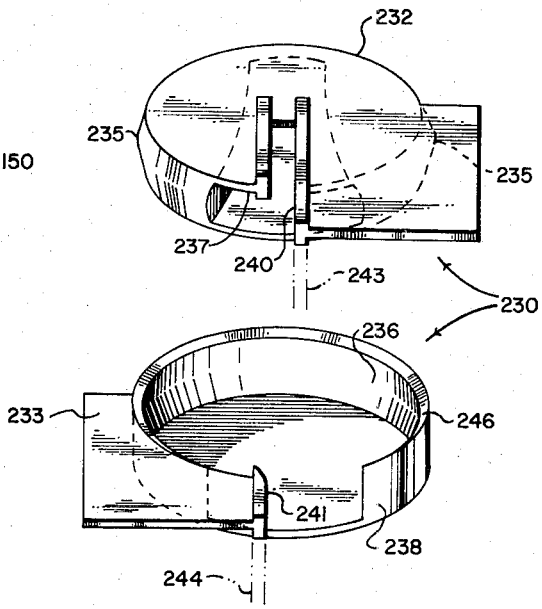
FIG. 9 is a perspective view of a sixth embodiment of the invention, in an open position.

FIG. 9 shows a sliding fastener 230 in which a slider base terminal 232 and free terminal 233 include parts of a snap insert fastener. Slider base terminal 232 has a convex surface 235 formed about much of the periphery thereof. Free terminal 233 has a generally cylindrical wall 238 of which the inner surface is concave in conformity with the convex surface 235 of the slider base terminal 232.

In operation, a slider (not shown) is seated fully rearward on slider base terminal 232, and terminal 232 is inserted into free terminal 233. Wall 238 flexes somewhat, allowing convex surface 235 to snap into place against concave surface 236. Slider base terminal 232 is rotated until guide segment 240 is against guide segment 241, if the fastener is not initially assembled with segment 240 in that position. Then the slider may be moved off the slider base terminal 232 and along interlocking elements 243 and 244. To unfasten sliding fastener 230, the slider is moved rearward until fully seated in base terminal 232; then the base terminal is unsnapped from free terminal 233.

The sliding fastener 230 has the advantage of being basically as simple to operate as a snap fastener. The operation may even be facilitated somewhat by a rim 246 which slopes downward toward the interior of free terminal 233 to help guide slider base terminal 232 into snapping position. Once the parts are snapped together and interlocking elements 243 and 244 are fastened, sliding fastener 230 is relatively secure against accidental unfastening.

The snapping parts of fastener 230 may have a variety of complementary configurations. Just as one example, surface 235 could be made concave, while surface 236 was made convex. As with other embodiments herein, the flexibility of wall 238 can be enhanced by slits therein, running in the direction of insertion of the slider base terminal.

Figure 10:
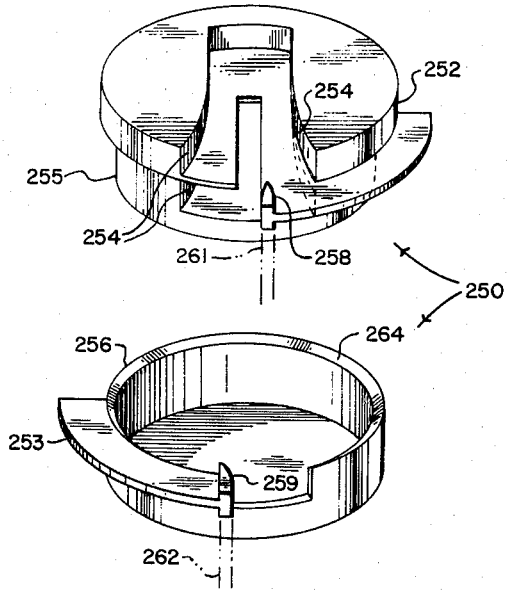
FIG. 10 is a perspective view of a seventh embodiment of the invention, in an open position.

Sliding fastener 250 in FIG. 10 has a slider base terminal 252 with a generally cylindrical bottom portion forming an upper part 255 of an insert fastener. On free terminal 253, a cylindrical wall conforming to upper part 255 forms the insert fastener lower part 256. The slider is held properly aligned on the base terminal 252 by walls 254 which engage the sides of the slider.

Slider base terminal 252, with a slider (not shown) seated fully to the rear thereof, is inserted in free terminal 253. Then terminal 252 is rotated until guide segment 258 is against guide segment 259, if not so initially. Then the slider is moved forward along interlocking elements 261 and 262 to fasten them.

If insert fastener part 255 is seated in part 256 to a significant depth, and if the fit between parts 255 and 256 is relatively close, then these parts can only separate by moving with respect to each other along their cylindrical axes. However, once the interlocking elements 261 and 262 are fastened, they prevent upper part 255 of insert fastener from sliding out of lower part 256 in the axial direction. As a result, sliding fastener 250 is secured against accidental unfastening even though the insert fastener parts 255 and 256 do not latch with respect to each other.

The primary advantage of sliding fastener 250 is the ease of inserting and removing the parts 255 and 256, with no latching or snapping being required. As with fastener 230 in FIG. 9, this can be facilitated still further by a shallow rim 264 sloping downward toward the interior of free terminal 253.

In a variation of fastener 250, the outer wall of upper part 255 and the inner wall of lower part 256 can be provided with corresponding microgrooves. These tiny, closely spaced grooves running parallel to the cylindrical axes of the parts cause substantial adhesion between parts 255 and 256 against separation when pulled in the direction of the axis. However, the parts can be readily joined and separated by twisting them in rotation about the axis.

Figure 11:
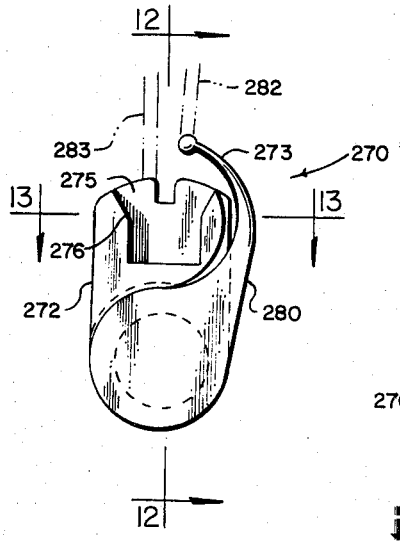
FIG. 11 is a plan view of an eighth embodiment of the invention, in a partially closed position.

In FIG. 11, a sliding fastener 270 has a slider base terminal 272 with portions 275 shaped to receive a slider. Portions 275 includes walls 276 (also shown in FIG. 13) shaped to abut the edges of the slider and thereby provide additional support of the slider and prevent it from wobbling on base terminal 272. Also as in other embodiments, the slider base terminal 272 includes one part 277 (seen in FIG. 12) of an insert fastener. Unlike previous embodiments, the slider receiving portions 275 are not in the midst of the fastener part 277; rather, the insert fastener part 277 is at the rear of base terminal 272, somewhat separate from the slider receiving portions.

Free terminal 273 includes an upper insert fastener part 278 corresponding to lower part 277. The fastener parts 277 and 278, shown joined in FIGS. 11 and 12, can be conventional snap fastener parts, for example. Free terminal 273 also includes an arm 280 shaped to extend alongside and in front of slider base terminal 272. Connected to the front of arm 280 is elongated interlocking element 282. Arm 280 is moved into position with respect to slider base terminal 272 by relative rotation of the insert fastener parts 277 and 278.

Figure 12:
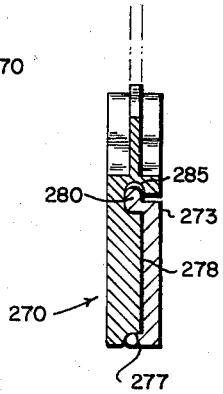
FIG. 12 is a sectional view taken along the line 12—12 indicated in FIG. 11.
Figure 13:
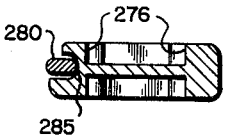
FIG. 13 is an additional section view taken along line 13—13 indicated in FIG. 11.

Slider base terminal 272 preferably includes a groove 285, either along the side thereof as illustrated in FIG. 13, or running transversely in a middle section as illustrated in FIG. 12, or both. Then, portions of arm 280 can be shaped for example, (as shown) so that they move into groove 285, when arm 280 is pushed completely against base terminal 272. Arm 280 engages the transverse portion of the groove first. This engagement then serves as an additional guide to completing the closing motion of the arm. This has the effect of latching base terminal 272 and free terminal 273 together, in addition to the latching provided by insert fastener parts 277 and 278. Moreover, the front end of arm 280 is formed as a tooth of interlocking element 282, and is therefore fastened to element 283, when the slider is moved forward. Thus, terminals 272 and 273 are fastened together by three different mechansims.

The terminals of sliding fastener 270 may be connected over a wide range of angles between interlocking elements 282 and 283. Where slider base terminal 272 is provided with groove 285, then terminals 272 and 273 may be connected with interlocking elements 282 and 283 almost parallel, just leaving enough room for arm 280 to clear the edge of the groove while fastener parts 277 and 278 are fastened, arm 280 can be rotated into groove 285.

Figure 14:
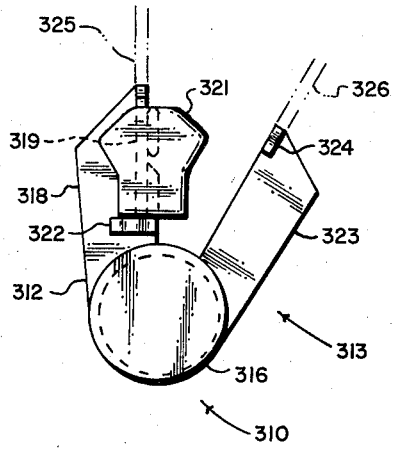
FIG. 14 is a plan view of a ninth embodiment of the invention, in a partially closed position.
Figure 15:
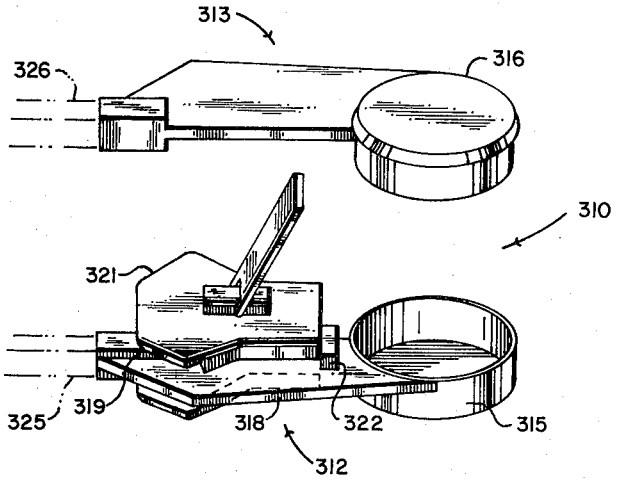
FIG. 15 is a perspective view of the embodiment of FIG. 14, in an open position.

FIGS. 14 and 15 illustrate a sliding fastener 380 somewhat similar to fastener 270 of FIGS. 11–13. At the rear of slider base terminal 312 and free terminal 313 are parts 315 and 316, respectively, of an insert fastener such as a conventional snap fastener. Slider base terminal 312 includes an arm 318 extending forward of insert fastener part 315. Arm 318 includes a guide segment 319 along which slider 321 moves, and a slider stop 322. Free terminals 313 includes an arm 323 extending forward from insert fastener part 316, with a guide segment 324 near the front of the arm.

As can be visualized from FIG. 14, the terminals 312 and 313 of sliding fastener 310 can be assembled over a wide angle, but not including an orientation with interlocking elements 325 and 326 generally parallel. Arm 323 must be rotated to one side enough to clear slider 321 as insert parts 315 and 316 are joined. Once they are joined, then free terminal 313 is rotated about fastener part 315 to move arm 323 through the side gap of slider 321 until interlocking element 326 is in position to be fastened by slider 321.

It is not necessary for the user of sliding fastener 310 to skillfully feed arm 323 through the side of slider 321. Insert fastener parts 315 and 316 are preferably constructed so that arm 323 rotates through a controlled, reproduceable arc into the side of slider 321. If the parts 315 and 316 engage each other snugly at relatively widely spaced points, the effect is to prevent wobble of the arm 323 in the direction perpendicular to the plane of the fabric.

Figure 16:
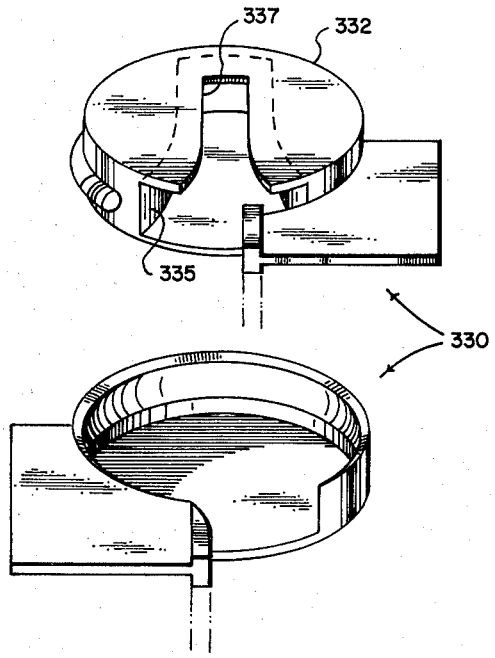
FIG. 16 is a perspective view of a tenth embodiment of the invention.

FIG. 16 shows a sliding fastener 330 which operates similarly to sliding fastener 230 of FIG. 9. However, sliding fastener 330 has a slider base terminal 332 which has a different means for holding the slider. Instead of the web 237 of sliding fastener 230 which fits between top and bottom sections of a slider (as also seen in FIG. 1), slider base terminal 332 includes a cavity 335 shaped to fit the exterior of a slider. An opening 337 in the top of terminal 332 permits access to the handle of the slider. Otherwise, operation of sliding fastener 330 is like that of the previously described fastener 230.

Figure 17A:
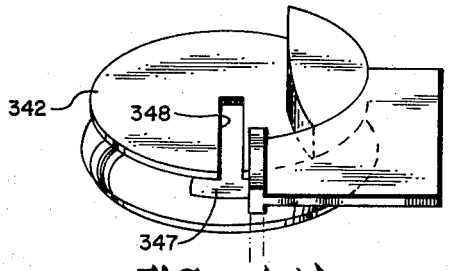
FIG. 17A is a perspective view of an eleventh embodiment of the invention, showing a slider base terminal thereof.
Figure 17B:
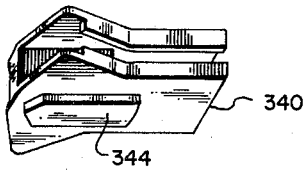
FIG. 17B is a perspective view of a slider in accordance with the embodiment of FIG. 17A.
Figure 17C:
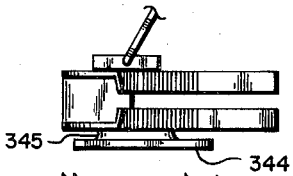
FIG. 17C is an elevation view of the slider of FIG. 17B.

FIGS. 17A, 17B, and 17C show yet another method of holding a slider 340 on a slider base terminal 342. Slider 340 has a plate member 344 connected by web 345 to the bottom of the slider. Slider base terminal 342 includes a slot 347 to receive plate 344 and a slot 348 to allow the passage of web 345. In this manner, slider 340 is held on slider base terminal 342.

Figure 18A:
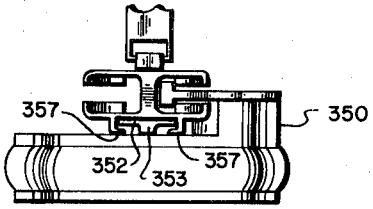
FIG. 18A is a front elevation view of a twelfth embodiment of the invention.
Figure 18B:
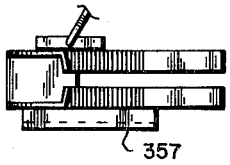
FIG. 18B is a side elevation of a slider shown in FIG. 18A.

FIG. 18A shows a slider base terminal 350 with a plate member 352 on a web 353. The associated slider 355 in FIGS. 18A and 18B includes flanges 357 projecting from the bottom of slider to hold the edges of plate 352 and thereby hold slider 355 on slider base terminal 350.

Figure 19:
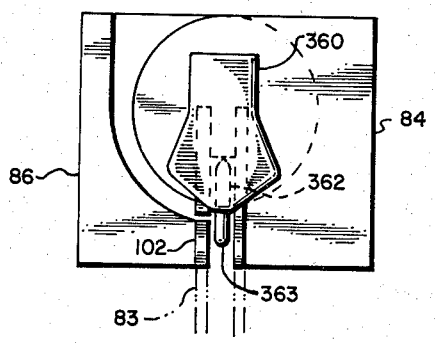
FIG. 19 is a plan view of a thirteenth embodiment of the invention, shown in a partially closed position.

FIG. 19 illustrates a variation of the arrangement shown in FIG. 5, using the same slider base terminal and free terminal. Slider 360 is not a conventional slider. The post 362 which conventionally connects the top and bottom portions of the slider includes an extended portion 363 which projects forward of the rest of the slider. During fastening, the slider base terminal 84 is rotated until the extended portion 363 of slider 360 comes against guide segment 102. At that point, the slider is properly aligned for moving out of the slider base terminal. This configuration provides an advantage in that no allowance need be made for guide segment 102 to enter through the side of the slider as in FIG. 5. Therefore, the slider base terminal 84 may be attached to the free terminal 86 even with elongated interlocking elements 82 and 83 aligned nearly parallel.

Figure 20:
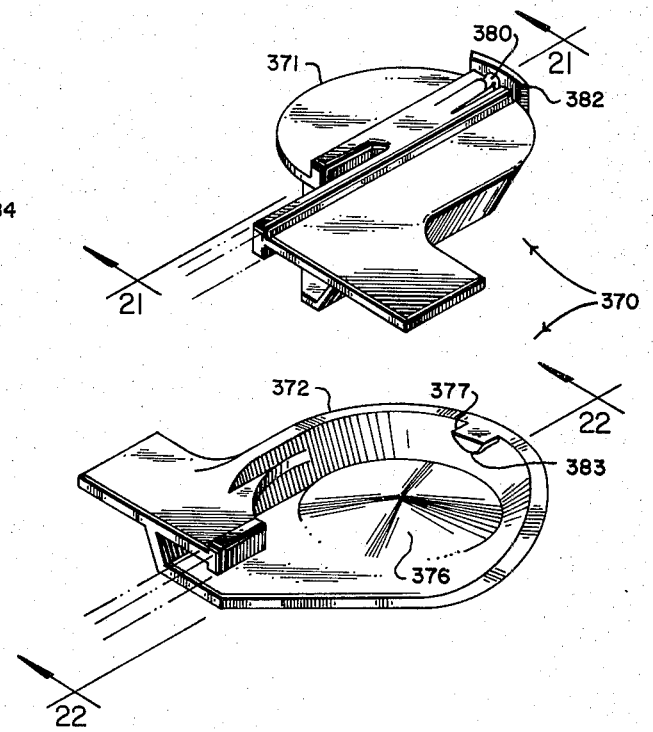
FIG. 20 is a perspective view of a fourteenth embodiment of the invention, shown in an open position.
Figure 21:
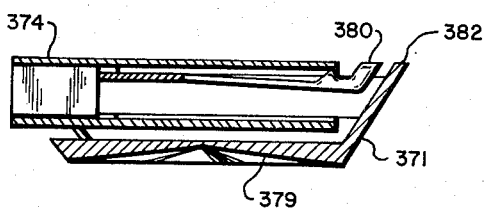
FIG. 21 is a cross-section of the fastener of FIG. 20, taken along line 21—21.
Figure 22:
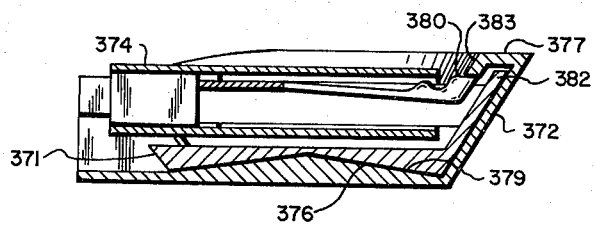
FIG. 22 is a cross-section of the fastener of FIG. 20, taken along line 22—22 and shown in a closed position.

FIG. 20 shows a sliding fastener 370 having a slider base terminal 371 and free terminal 372. A cross-section of slider base terminal 371 with a slider 374 thereon is shown in FIG. 21. FIG. 22 shows a cross-section of terminal 371 fastened into free terminal 372. Particularly noteworthy in free terminal 372 are a conical raised portion 376 and an overhanging member 377. Slider base terminal 371 has an indented conical portion 379 (FIGS. 21 and 22) conforming to the conical raised portions 376 of the free terminal and an upwardly projecting member 382 which fits under overhanging member 377 during fastening.

Base terminal 371 includes a depressable resilient catch 380. When slider 374 is not on slider base terminal 371, catch 380 is in an unflexed upward position illustrated in FIG. 20. As seen in FIG. 21, when slider 374 is seated on the terminal base 371, catch 380 is depressed and bears against the inside upper surface of the slider. This prevents the slider from becoming jostled slightly off the slider base terminal and interfering with the fastening of base terminal 371 to free terminal 372. It is possible to modify the slider to have a special indentation or projection which is engaged by catch 380. In another modification, a resilient catch like catch 380 is mounted on the slider so as to engage the slider base terminal.

To fasten sliding fastener 370, indented portion 379 of the slider base terminal is placed over the raised portion 376 of the free terminal. The two terminals are initially rotated with respect to each other so that upwardly projecting member 382 and overhanging member 377 are separate. Once indented portion 379 has been seated on raised portion 376, slide base terminal 371 is rotated with respect to the free terminal so that upwardly projecting member 382 latches beneath overhanging member 377, thus fastening the two terminals together. As shown in FIG. 22, an element 383 projecting downwardly from overhanging member 277 further depresses catch 380 at this point, freeing slider 374 to move. Thus, slider 374 is held on slider base terminal 371 by catch 380 until the slider base terminal is in proper position for the slider to move along the interlocking elements of fastener 370, at which point the slider is released.

The interaction of raised conical portion 376 and indented conical portion 379 serves to guide the initial insertion of slider base terminal 371 into free terminal 372 and subsequent rotation of the two with respect to each other. The initial insertion can be enhanced, particularly for use at night, by incorporating a phosphorescent or glowing spot near the peak of raised portion 376.

To unfasten sliding fastener 370, slider 374 is seated fully rearward on slider base terminal 371. Then the slider base terminal is rotated with respect to the free terminal so that upwardly projecting member 382 moves out from under overhanging member 377. At this point, catch 380 springs up, holding slider 374 in place, and the slider base terminal may be lifted out of the free terminal.

Figure 23:
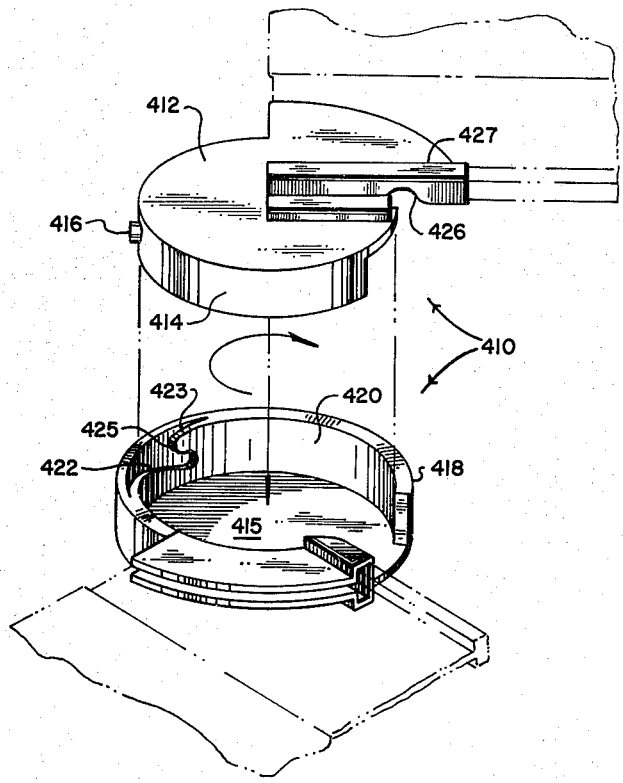
FIG. 23 is a perspective view of a fifteenth embodiment of the invention, shown in an open position.

FIG. 23 shows a sliding fastener 410 in which the slider base terminal 412 contains a protruding part 414 of an insert fastener. A small cylinder member 416 projects outward from the periphery of protruding part 414. Free terminal 418 includes recessed part 415 of the insert fastener. Formed in the interior wall 420 of recessed part 415 are first cam surface 422 and second cam surface 423.

Figure 24:
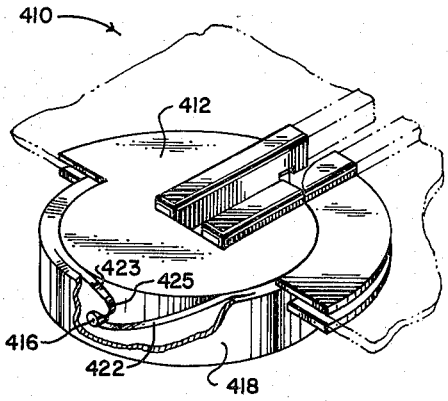
FIG. 24 is a perspective view of the fastener of FIG. 23, shown in a closed position, with portions broken away.
Figure 26:
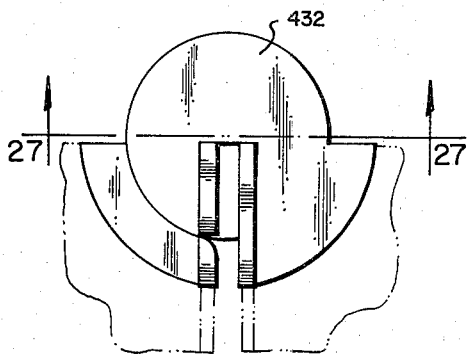
FIG. 26 is a plan view of the fastener of FIG. 25, shown in the closed position.

In the operation of the sliding fastener 410, protruding part 414 of the insert fastener is inserted into recessed part 415, bringing member 416 on to cam surface 422 or surface 423. When member 416 is on cam surface 422, the slider base terminal 412 is pressed downward and rotated with respect to free terminal 418, so that member 416 follows cam surface 422 to reside in a terminal position shown in FIG. 24. In the position seen in FIG. 24, the rear part of slider base terminal 412 is held into free terminal 418 by member 416 latching beneath overhanging member 425. The two parts of the insert fastener are unlatched by twisting slider base terminal 412. A smooth notch 426 in guide segment 427 prevents the guide segment from hitting the side wall of free terminal 418 during fastening and unfastening of fastener 410.

If the terminals of the sliding fastener 410 are positioned at a rotational angle with respect to each other so that the interlocking elements thereof are slightly overlapping, member 416 will come down on the second cam surface 423 when protruding part 414 is inserted into recessed part 415. The downwardly sloping cam surface 423 will direct member 416 down on to first cam surface 422, on which member 416 will move into the terminal position of FIG. 24.

Figure 25:
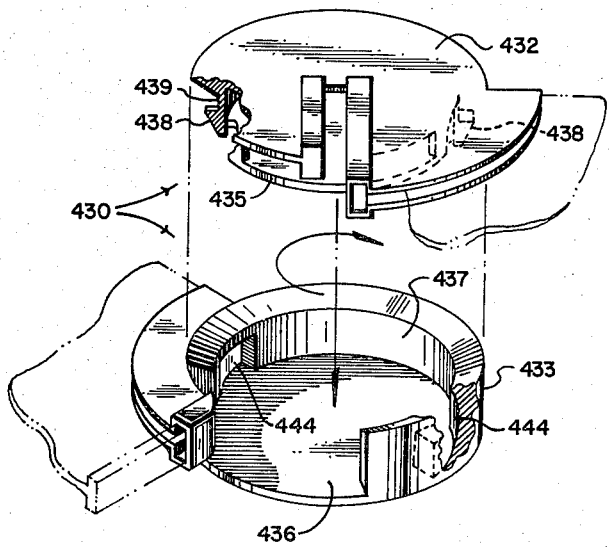
FIG. 25 is a perspective view of a sixteenth embodiment of the invention, shown in an open position, with portions broken away.
Figure 28:
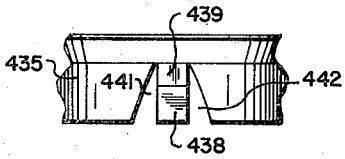
FIG. 28 is a side elevation view of a portion of the fastener of FIG. 25.

FIG. 25 shows a sliding fastener 430 in which a slider base terminal 432 again has a protruding part 435 of an insert fastener, while free terminal 433 includes the recessed part 436 of the insert fastener. Extending outwardly from the walls of protruding part 435 are projections 438. As particularly seen in FIG. 28, open spaces 441 and 442 in the wall of protruding part 435 leave a strip of wall on which projections 438 are mounted. Provided that protruding part 435 is of a relatively flexible material, the strips 439 will have flexibility and thereby provide a resilient mounting for projections 438.

Figure 27:
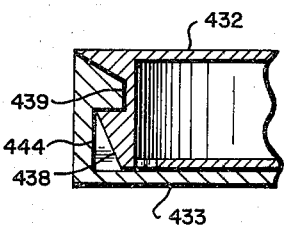
FIG. 27 is a cross-section of the fastener of FIG. 26, taken along line 27—27.

In the interior wall of recessed part 436 are formed indentations 444. These indentations begin at the main surface of the inner wall of recessed part 436 and grow progressively deeper in the direction in which protruding part 435 is rotated during fastening so as to align the interlocking elements of the slider. In operation, when slider base terminal 432 is inserted in free terminal 433, projections 438 are pressed toward the center of protruding part 435 by contact with inner wall 437. Then as the slider base terminal 432 is rotated so as to align the slider with the interlocking elements of the fastener, projections 438 move into indentations 444 progressively more deeply until the alignment is reached. At that point, as seen in FIG. 27, slider base terminal 432 is locked into free terminal 433 by the latching of projections 438 into indentations 444.

To remove slider base terminal 432 it is rotated so as to move the elongated interlocking elements apart. Projections 438 move to progressively shallower portions of indentations 444 until projections 438 are once again in contact with the main portion of inner wall 437 of recessed part 436. Then slider base terminal 432 may be lifted out of free terminal 433.

Figure 29:
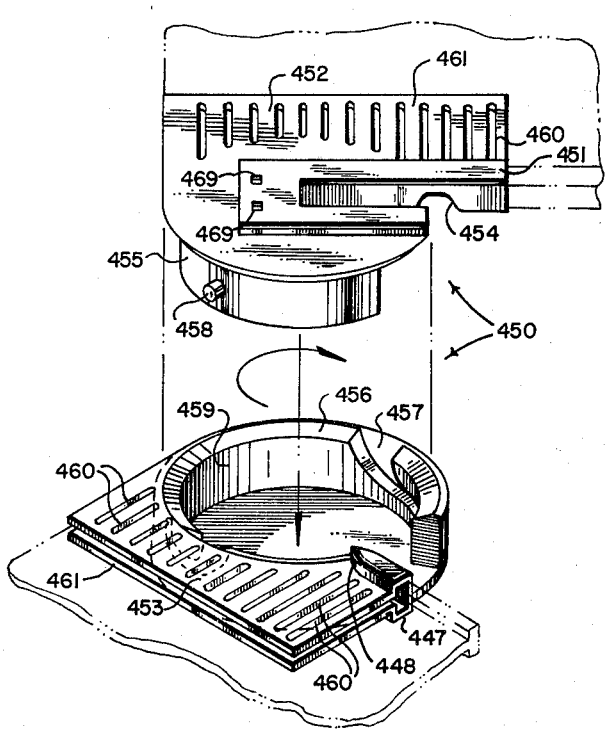
FIG. 29 is a perspective view of a seventeenth embodiment of the invention shown in an open position.
Figure 30:
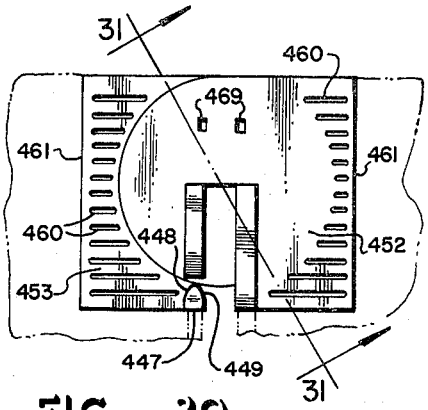
FIG. 30 is a plan view of the fastener of FIG. 29.

In sliding fastener 450 of FIG. 29, slider base terminal 452 includes a protruding part 455 of an insert fastener. Projections 458 extend outwardly from protruding part 455. Free terminal 453 includes a recessed part 456, having an inner wall 459. Formed in inner wall 459 are slots 457 which are open at the top and extend progressively downward in the direction in which slider base terminal 452 is rotated when moving the interlocking elements of the sliding fastener together.

Figure 31:
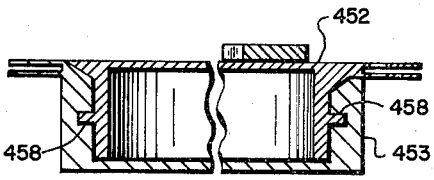
FIG. 31 is a cross-section of the fastener of FIG. 30, taken along the line 31—31.

In operation, slider base terminal 452 is lowered toward free terminal 453, inserting projections 458 into the upwardly opening portion of slots 457. Notch 454 in guide segment 451 prevents the guide segment from obstruction by the wall of free terminal 453 during insertion. Then slider base terminal 452 is rotated with respect to free terminal 453 so as to bring the elongated interlocking elements together, and in so doing, projections 458 are brought more deeply into slots 457. In FIG. 31, projections 458 are seen fully seated in slots 457, thus latching slider base terminal 452 onto free terminal 453. To unfasten slider base terminal 452, it is rotated in the opposite direction and lifted out.

The attachment flanges 461 of sliding fastener 450 include rows of slots 460. The slots are in both bottom and top portions of the flanges, so that a needle may extend through the slots and through fabric inserted therein. By this means, the fastener 450 can be sewn to a garment.

In the top of slider base terminal 453 of sliding fastener 450 is a pair of holes 469. These holes receive anti-skid prongs commonly provided on the underside of the top part of a conventional zipper slider. The prongs move up and down dependent on the position of the handle of the slider to minimize undesired motion of the slider along the zipper. The presence of the prongs in holes 469 serves to hold the slider still on slider base terminal 452.

Free terminal guide segment 447 includes cam surfaces 448 and 449 on each side. Surface 448 can be engaged by side portions of the zipper slider to facilitate the slider properly aligning with the guide segment to move along it.

Figure 32:
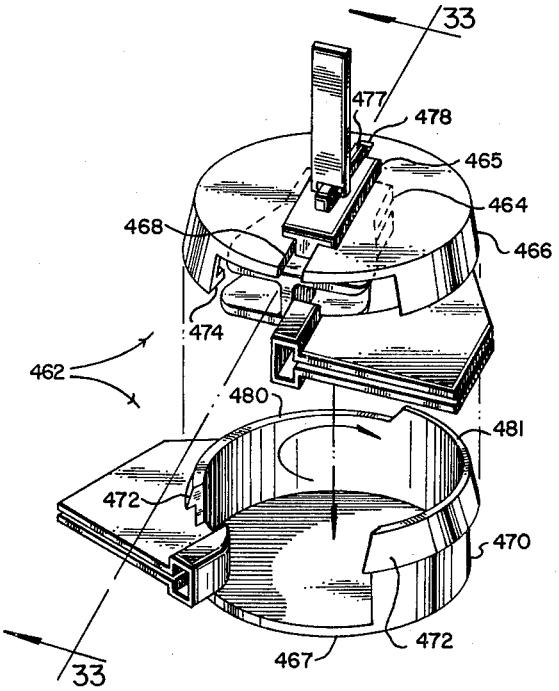
FIG. 32 is a perspective view of an eighteenth embodiment of the invention, shown in an open position.
Figure 33:
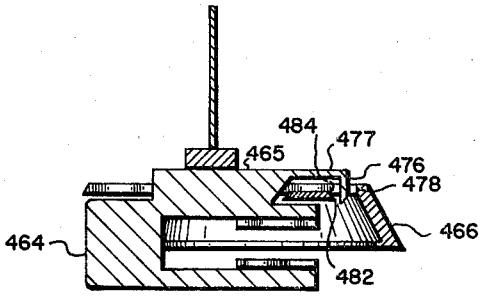
FIG. 33 is a cross-section of the fastener of FIG. 32 taken along the line 33—33.

In sliding fastener 462 of FIGS. 32 and 33, slider 464 has a special flanged member 465 projecting from the top thereof. Slider base terminal 466 includes a slot 468 which receives flanged member 465 to hold slider 464.

Free terminal 467 includes a protruding part 470 of an insert fastener, including an overhanging member 472. Slider base terminal 466 includes a recessed part 471 of an insert fastener, including member 474 projecting inwardly. The walls of recessed part 471 and protruding part 470 are preferably made of a flexible material such as plastic so that slider base terminal 466 can be pushed down on top of free terminal 467, with projecting member 474 latching beneath overhanging member 472 to hold the two terminals together. The flexibility of both protruding part 470 and recessed part 471 can be enhanced by vertical slits formed in the walls of the parts.

As seen particularly in FIG. 33, slider 464 includes at the rear of the flange member 465 a rearwardly extending arm 477 terminating in a downwardly projecting catch 476. In FIG. 33, catch 476 and arm 477 are shown in the position they occupy when sliding fastener 462 is open. Catch 476 projects downwardly into an opening 478 in the top of slider base terminal 466. If slider base terminal 466 is placed on free terminal 467 with the elongated interlocking elements of the fastener somewhat separated, catch 476 is over lower portion 480 of protruding part 470. When the rotational position of slider base terminal 466 is such that slider 464 is aligned for the closure of the elongated interlocking elements of the fastener, catch 476 at the rear of the slider is above higher portion 481 of protruding part 470. The higher portion 481 engages catch 476 pushing it slightly upward to clear the edge 482 of opening 478. In that position, catch 476 is in a position to move up cam surface 484 of opening 478 when the slider is pulled forward by the user. Thus there is provided a mechanism to hold slider 464 on base terminal 466 until the slider is properly aligned with the elongated interlocking elements of the fastener, at which the time the slider may be pulled forward to lock those elements.

Figure 34:
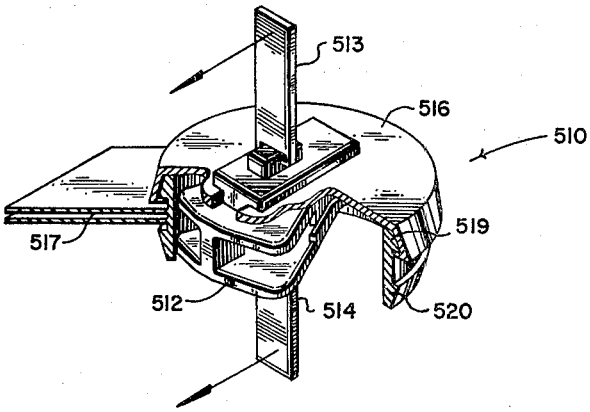
FIG. 34 is a cutaway perspective view of a nineteenth embodiment of a fastener according to the invention, shown in a closed position.

FIG. 34 shows portions of a sliding fastener 510 for use with a reversible garment. Slider 512 has handles 513 and 514 on both top and bottom thereof. Free terminal 517 has two oppositely facing protruding parts 519 and 520 of an insert fastener. Slider base terminal 516 includes a recessed part 521 which fastens to the protruding parts 519 and 520 in the same manner as in sliding fastener 462 of FIG. 32. With the garment turned one way, recessed part 521 fastens on to protruding part 519, as shown in FIG. 34. When the garment is turned inside out, recessed part 521 fastens to protruding part 520.

Although preferred embodiments of the invention have been described in detail, it is to be understood that various changes, substitutions, and alterations can be made therein, without departing from the spirit and scope of the invention as defined by the appended claims.

I claim:

1. In a sliding fastener of the type used for joining sections of a garment and having first and second elongated interlocking elements each attached to one of said sections by a stringer, with said elememts being brought together into side by side interlocking relationship by a slider moving longitudinally along the elements, the improvement comprising:

an insert fastener including two complementary parts;

first means at one end of said first interlocking element for holding the slider in a position to be moved longitudinally to engage the first interlocking element, said first means including one of the insert fastener parts therewith; and second means, at a corresponding end of said second interlocking element and including the other of the insert fastener parts therewith, for permitting said insert fastener to be closed by moving said parts together in a direction substantially non-parallel with said stringers, including while said elongated elements are positioned side by side, and for guiding the engagement of the slider with the second interlocking element when the insert fastener is closed.

2. In a sliding fastener of the type used for joining sections of a garment and having first and second elongated interlocking elements each attached to one of said sections by a stringer, with said elements being brought together into side by side interlocking relationship by a slider moving longitudinally along the elements, the improvement comprising:

an insert fastener including a recessed part and a protruding part conforming to the recessed part for insertion therein;

first means, at one end of said first interlocking element and including one of the insert fastener parts therewith, for holding the slider in a position to be moved longitudinally to engage the first interlocking element, said slider being held in superposition with said one insert fastener part, whereby said one part may be directed toward the other part by gripping of the slider; and second means at a corresponding end of said second interlocking element and including the other of the insert fastener parts therewith for closing the insert fastener by moving said parts together in a direction substantially non-parallel with said stringers and for guiding the engagement of the slider with the second interlocking element when the insert fastener is closed.

3. The sliding fastener of claim 2, wherein one of said means includes an overhanging member and the other of said means has a corresponding member capable of being latched under said overhanging member when the insert fastener is closed, thereby securing the closure of the insert fastener.

4. The sliding fastener of claim 3, wherein said parts are disposed with the fronts thereof toward said interlocking elements, and wherein said overhanging and corresponding members are included at the rear portions of said parts.

5. The sliding fastener of claim 4, wherein said corresponding member is disposed to be latched under said overhanging member by moving rearwardly.

6. The sliding fastener of claim 2, wherein said recessed and protruding parts are round and include means for rotating said parts with respect to each other after said insert fastener is closed, to align the slider for engaging the interlocking elements.

7. In a sliding fastener of the type used for joining sections of a garment and having first and second elongated interlocking elements each attached to one of said sections by a stringer, with said elements being brought together into side by side interlocking relationship by a slider moving longitudinally along the elements, the improvement comprising:

an insert fastener including
- a recessed part and
- a protruding part conforming to the recessed part for insertion therein;

first means, at one end of said first interlocking element and including one of the insert fastener parts therewith, for holding the slider in a position to be moved longitudinally to engage the first interlocking element, said slider being held in superposition with said one insert fastener part, whereby said one part may be directed toward the other part by gripping of the slider; and second means at a corresponding end of said second interlocking element and including the other of the insert fastener parts therewith for closing the insert fastener by moving said parts together in a direction substantially non-parallel with said stringers and for guiding the engagement of the slider with the second interlocking element when the insert fastener is closed;

wherein the slider has a gap along each side for permitting the passage of the stringer and said first means includes at least two plate portions, each for insertion in one of the side gaps of the slider, at the rear thereof, to hold the slider whenever the slider is moved from the interlocking elements onto said first means.

8. The sliding fastener of claim 7, wherein at least one of said plate portions includes a guide segment thicker than the plate portion for insertion in the rear of the slider as the slider is moved from the interlocking elements onto said first means, thereby to guide the motion of the slider on said first means.

9. The sliding fastener of claim 7, wherein said second means includes, at said corresponding end of the second interlocking element, a guide segment for guiding the engagement of the slider with the second interlocking element.

10. The sliding fastener of claim 9, wherein said guide segment further includes a cam surface for engagement by said slider in achieving alignment of the interlocking elements.

11. In a sliding fastener of the type used for joining sections of a garment and having first and second elongated interlocking elements each attached to one of the sections by a stringer, with the elements being brought together into side-by-side interlocking relationship by a slider moving longitudinally along the elements, the improvement comprising:

an insert fastener including
- a recessed part and
- a protruding part conforming to the recessed part for insertion therein;

first means, at one end of the first interlocking element and including one of the insert fastener parts therewith, for holding the slider in a rearward position from which it can be moved longitudinally forward to engage the first interlocking element, the slider being held in the rearward position at least partially within the recessed part once the protruding part has been inserted in the recessed part, whereby said one part may be directed toward the other part by gripping of the slider; and second means at a corresponding end of the second interlocking element and including the other of the insert fastener parts therewith for closing the insert fastener by moving the parts together in a direction substantially perpendicular with said stringers and for guiding the engagement of the slider with the second interlocking element when the insert fastener is closed.

* * * * *